US006906581B2

(12) United States Patent
Kang et al.

(10) Patent No.: US 6,906,581 B2
(45) Date of Patent: Jun. 14, 2005

(54) FAST START-UP LOW-VOLTAGE BANDGAP VOLTAGE REFERENCE CIRCUIT

(75) Inventors: Tzung-Hung Kang, Hsinchu (TW); Chao-Cheng Lee, TaoYuan (TW)

(73) Assignee: Realtek Semiconductor Corp., Hsinchu (TW)

( * ) Notice: Subject to any disclaimer, the term of this patent is extended or adjusted under 35 U.S.C. 154(b) by 0 days.

(21) Appl. No.: 10/424,902

(22) Filed: Apr. 29, 2003

(65) Prior Publication Data

US 2003/0201822 A1 Oct. 30, 2003

(30) Foreign Application Priority Data

Apr. 30, 2002 (TW) ..... 91109183 A

(51) Int. Cl.[7] ..... G05F 1/10

(52) U.S. Cl. ..... 327/539; 327/541; 327/542; 323/313

(58) Field of Search ..... 327/513, 539, 327/538, 540, 541, 542, 543, 315, 537; 323/313

(56) References Cited

U.S. PATENT DOCUMENTS 6,563,295 B2 * 5/2003 Juang ..... 323/315
6,563,370 B2 * 5/2003 Coady ..... 327/539
6,563,371 B2 * 5/2003 Buckley et al. ..... 327/539
2002/0093325 A1 * 7/2002 Ju ..... 323/316
2003/0038672 A1 * 2/2003 Buckley et al. ..... 327/539
2003/0123522 A1 * 7/2003 Hsu et al. ..... 374/185

* cited by examiner

*Primary Examiner*—Terry D. Cunningham
(74) *Attorney, Agent, or Firm*—Troxell Law Office, PLLC

(57) ABSTRACT

A fast start-up low-voltage bandgap voltage reference circuit is disclosed. The bandgap voltage reference circuit includes: a first current generator, which is implemented by a self-bias unit and a current mirror for generating a first reference current with positive temperature coefficient; a second current generator, which is connected to a point with negative temperature coefficient in the first current generator to generate a second reference current with negative temperature coefficient; and a resistor for converting the first reference current and the second reference current into a low-voltage bandgap voltage independent of temperature. Because the bandgap voltage reference circuit of the invention uses the resistor to convert the first reference current and the second reference current into voltage, the circuit can provide low-voltage bandgap voltage.

14 Claims, 4 Drawing Sheets

FAST START-UP LOW-VOLTAGE BANDGAP VOLTAGE REFERENCE CIRCUIT

BACKGROUND OF THE INVENTION

1. Field of the Invention

The present invention generally relates to a bandgap voltage reference circuit, more particularly, to a fast start-up low-voltage bandgap voltage reference circuit.

2. Description of the Prior Art

In general, reference voltage can be generated by voltage-dividing of resistors or by the self-bias of a transistor. However, such reference voltage is not independent of working voltage and temperature, as well as the variation in the manufacturing. In order to solve the problems, a bandgap voltage reference circuit is provided.

The principle of the bandgap voltage reference circuit is to implement components having characteristics of positive temperature coefficient and negative temperature coefficient respectively. And then add the voltages or the currents of these components in a predetermined proper proportion to generate a value independent of temperature, and such value can be output as a reference.

FIG. 1 is a diagram showing the bandgap voltage reference circuit in such kind. As shown, the transistors M1, M2, Q1, Q2, the resistor R1 and the amplifier OP1 form a self-bias circuit generating a current in positive proportion to $$\frac{V_T \ln N}{R1},$$

wherein N is the Emitter Area Ratio of the transistors Q1 and Q2. Therefore, the bandgap voltage Vbg is:

$$Vbg = V_{BE2} + R_2 \frac{V_T \ln N}{R1} \tag{1}$$

wherein $V_{BE2}$ has a negative temperature coefficient −2.2 mV/° C., and $V_T$ has a positive temperature coefficient +0.85mV/° C. Aspect Ratio of M1, M2 and M3 are all equal, the Formula (1) can be rewritten as:

$$V_{BG}(T) = (V_{BE0} - 2.2 \times 10^{-3} \cdot \Delta T) + \frac{(V_{T0} + 0.085 \times 10^{-3} \cdot \Delta T) \ln N}{R1} \cdot R2$$

wherein ΔT=T−300 ° K (i.e. the difference of working temperature and the room temperature), $V_{BE0}$ is $V_{BE}$ under room temperature and the value is around 0.6V, $V_{T0}$ is $V_T$ under room temperature and the value is around 0.026V. In order to make the temperature coefficient of $V_{BG}$ equal to "0", make $$\frac{\partial V_{BG}}{\partial T} = 0, \text{ then } -2.2 \times 10^{-3} T + \frac{(0.085 \times 10^{-3} T) \cdot \ln N}{R1} \cdot R2 = 0.$$

So, $$\frac{\ln N}{R1} \cdot R2 = 25.88, \ \frac{V_{T0} \ln N}{R1} \cdot R2 = 25.88 \times 0.026 = 0.67,$$

then make ΔT=0, and the Formula (1) will become:

$$V_{BG} = V_{BE0} + \frac{V_{T0} \ln N}{R1} \cdot R2 = 0.6 + 0.67 + 1.27$$

In general, $V_{BG}$ is around 1.27V, and the value varies depending on different manufacturing processes (for example, $V_{BE0}$ may vary between 0.5V~0.7V). Even the bandgap voltage Vbg independent of temperature can be obtained, however, it should be around 1.2V to offset the positive/negative temperature coefficient, which means this circuit will not work when the working voltage VCC is lower than 1.2 V.

FIG. 2 shows a low-voltage bandgap voltage reference circuit pretty common in prior art, in which the circuit will work under low VCC. As shown in FIG. 2, the resistor R2 is connected parallel to the resistors R3 and R4 having voltages Va and Vb respectively, which is a modification of the circuit shown in FIG. 1 in which the resistor R2 is connected serial to the voltage Vb. Assuming R3=R4 and the transistors M1, M2, Q1, Q2, the resistor R1 and the amplifier OP1 form a self-bias circuit. When the self-bias circuit is steady, the corresponding currents will be:

$$I_{R3} = \frac{V_a}{R3} = \frac{V_{BE1}}{R3} \tag{2}$$

$$I_{Q1} = \frac{V_T \ln N}{R1} \tag{3}$$

$$I_{M1} = I_{M3} = I_{R3} + I_{Q1} = \frac{V_{BE1}}{R3} + \frac{V_T \ln N}{R1} \tag{4}$$

Therefore, changing the proportion between the R1 and R3 will generate a current independent of temperature. With R5, the current can be transformed to the bandgap voltage Vbg as follows, $$Vbg = R5\left(\frac{VBE1}{R3} + \frac{VT \ln N}{R1}\right) \tag{5}$$

Since the circuit in FIG. 2 is achieved by the addition of currents ($I_{R3}$+$I_{Q1}$), it will not be limited by the condition that the working voltage should be around 1.2V (as the prior art illustrated in FIG. 1) and will work below 1V. However, when starting, the currents on the transistors Q1 and Q2 are much lower than that on the resistors R3 and R4, and also R3=R4, so the voltage Va is almost equivalent to Vb. In such circumstances, the amplifier OP1 will not pull up the self-bias voltage to a steady stage. Therefore, when starting, the self-bias circuit needs to be set up to a steady stage with an external reset signal. For example, As shown in FIG. 2, the starting unit 21 provides a reset signal to turn on an auxiliary transistor Mx when the self-bias circuit is not in the steady stage. And then the starting unit 21 has to monitor the current Ix on the transistor M0 to turn off the auxiliary transistor Mx when the current Ix reaches to a threshold value (i.e. when the self-bias circuit reaches the steady stage). In one embodiment, the starting unit 21 comprises a power-on reset circuit.

SUMMARY OF THE INVENTION

The primary object of the present invention is to provide a fast start-up low-voltage bandgap voltage reference circuit which can fast start up and work under low voltage.

The fast start-up low-voltage bandgap voltage reference circuit of the present invention comprises: a first current generator, which is implemented by a self-bias unit and a current mirror for generating a first reference current with positive temperature coefficient; a second current generator, which is connected to a node with negative temperature coefficient in the first current generator to generate a second reference current with negative temperature coefficient; and an output resister for converting the first reference current and the second reference current into a low-voltage bandgap voltage independent of temperature.

Wherein the self-bias circuit further comprises a first pair of transistors M1 and M2 with the gates connected to each other; a first amplifier whose output end is connected to the gates of the transistors M1 and M2 and whose input ends are connected to the drains of the transistors M1 and M2 respectively; a third transistor Q1 whose emitter is connected to one input end of the first amplifier; a first resistor; and a fourth transistor Q2 whose emitter is connected to another input end of the first amplifier through the first resistor.

Since the bandgap voltage of the bandgap voltage reference circuit of the present invention is generated by using the output resistor to transform the current obtained from adding the first reference current which has a positive temperature coefficient and the second reference current which has a negative temperature coefficient, therefore the bandgap voltage reference circuit of the present invention will work normally when the working voltage VCC is lower than 1.2 V. Moreover, the circuit of the first and the second transistors are not connected parallel with the resistor, so the first amplifier will obtain a bigger voltage difference between the two input ends when starting, which enables the first pair of transistors M1 and M2 to become steady rapidly.

Other and further features, advantages and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits and advantages of the preferred embodiments of the present invention will be readily understood by the accompanying drawings and detailed descriptions, wherein.

DETAILED DESCRIPTION OF THE PRESENT INVENTION

The following embodiments will illustrate the fast start-up low-voltage bandgap voltage reference circuit of the present invention in detail.

Figure 1:
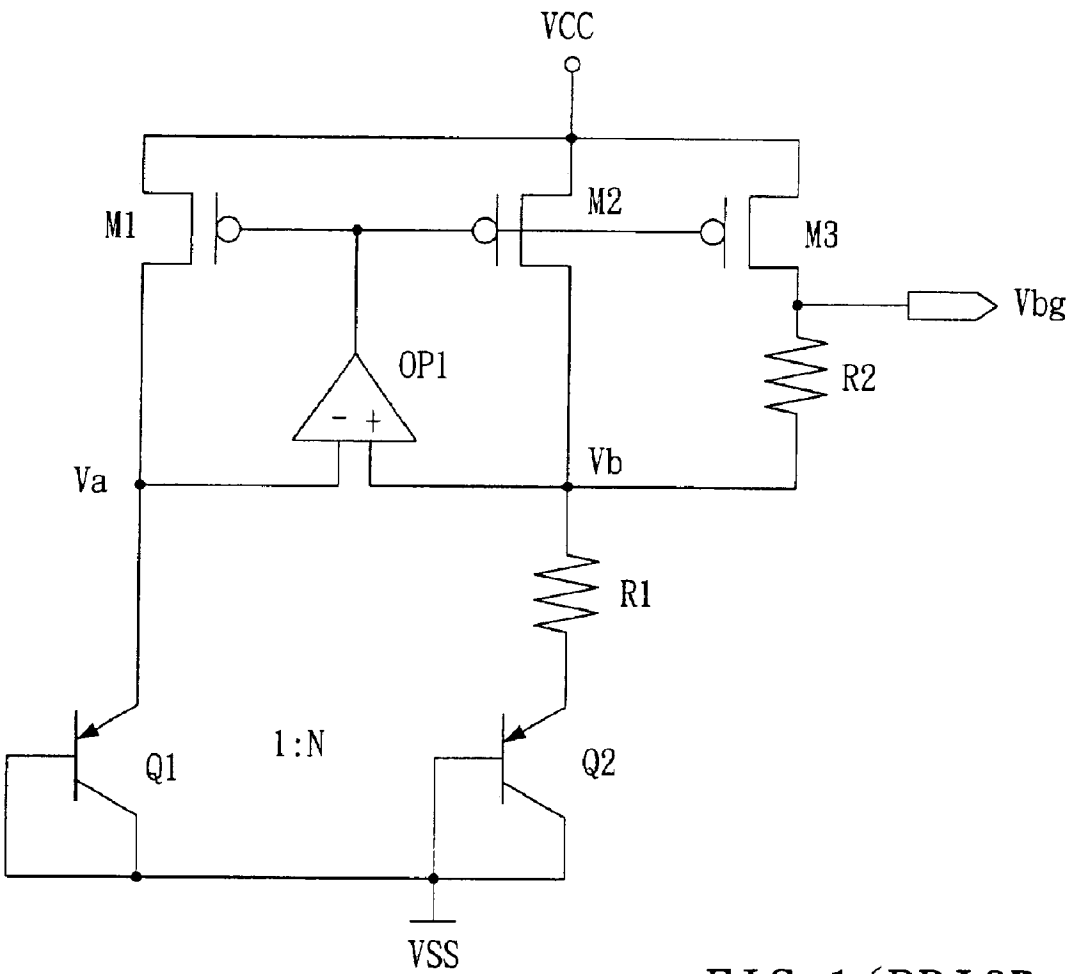
FIG. 1(PRIOR ART)
FIG. 1 shows the diagram of a bandgap voltage reference circuit in prior art.
Figure 2:
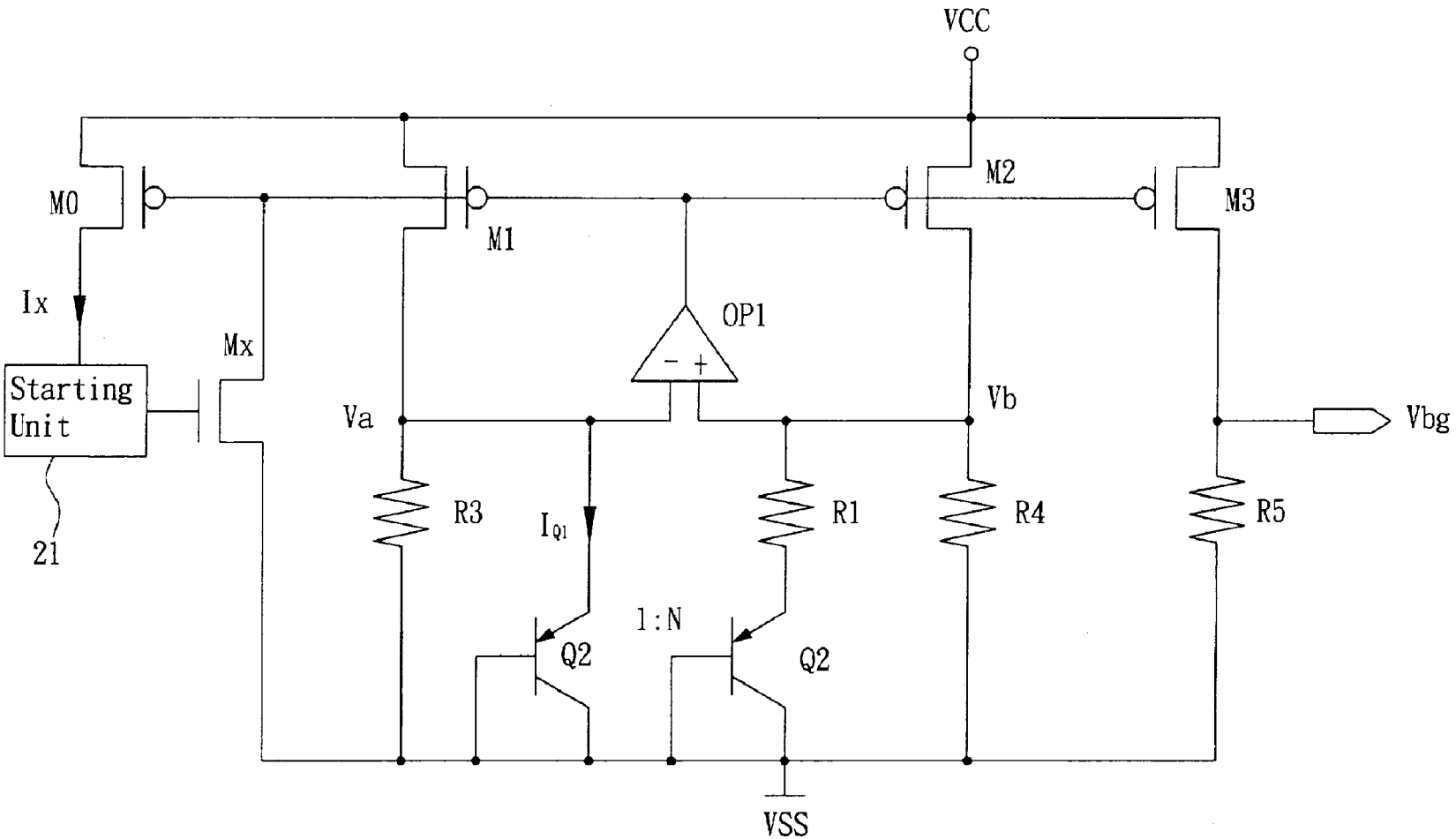
FIG. 2(PRIOR ART)
FIG. 2 shows the diagram of a low-voltage bandgap voltage reference circuit in prior art.
Figure 3:
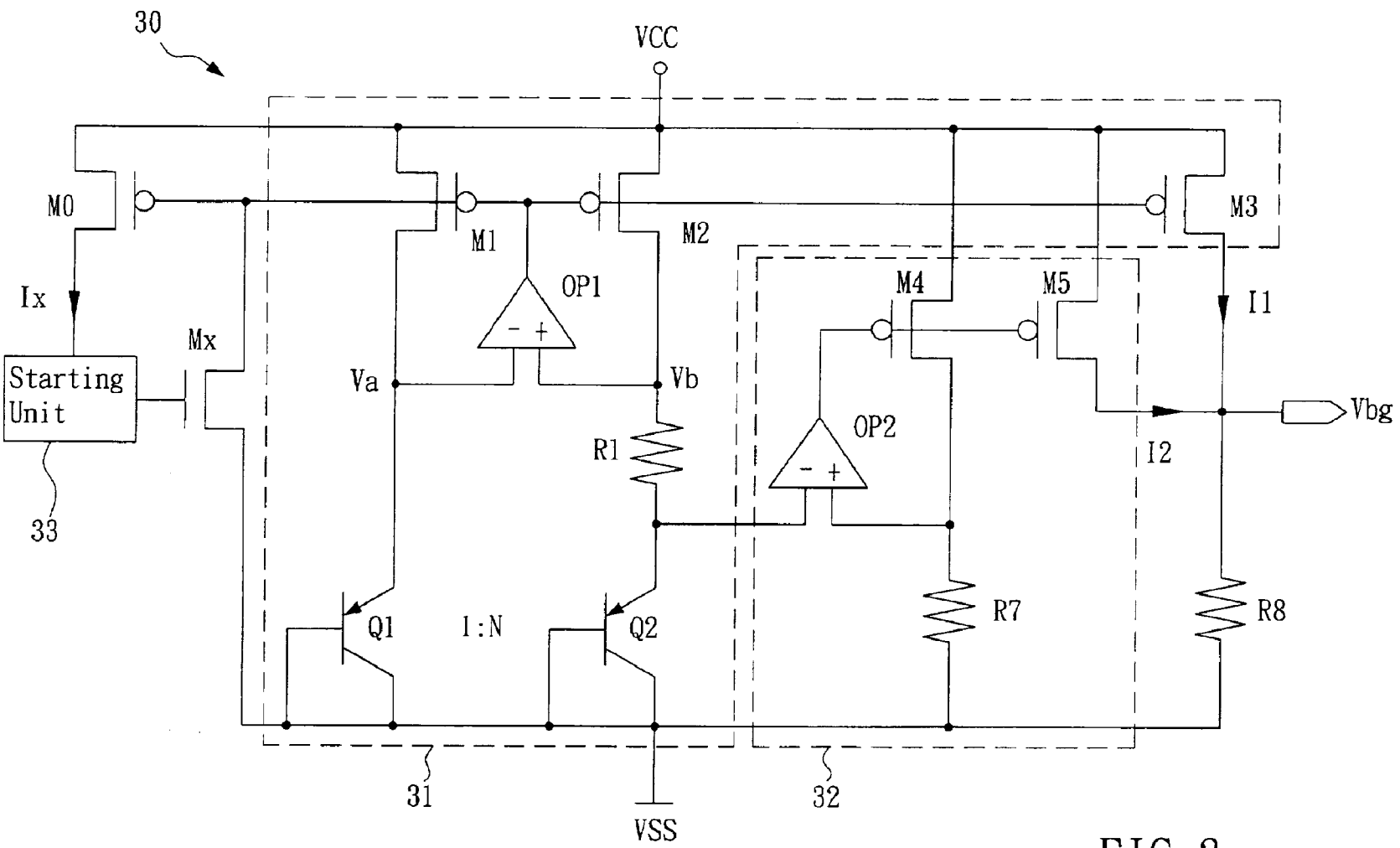
FIG. 3 shows the diagram of an embodiment of the fast start-up low-voltage bandgap voltage reference circuit in accordance with the present invention.

FIG. 3 is showing the diagram of an embodiment of the fast start-up low-voltage bandgap voltage reference circuit of the present invention. As shown in FIG. 3, the fast start-up low-voltage bandgap voltage reference circuit 30 of the present invention comprises two current generators, namely the first current generator 31 and the second current generator 32. The first current generator 31 is substantially the same with the conventional bandgap voltage reference circuit shown in FIG. 1. The first current generator 31 shown in FIG. 3 is used to generate a first reference current I1 with positive temperature coefficient, while the second current generator 32 is used to generate a second reference current 12 with negative temperature coefficient.

As shown in FIG. 3, the output end of the first amplifier OP1 is connected to both gates of the first and the second transistors M1, M2. The first input end (e.g. the negative input end) and the second input end (e.g., the positive input end) of the first amplifier OP1 are connected to the drains of the first and the second transistors M1, M2 respectively. The third transistor Q1 includes a third emitter which is connected to the first input end of the first amplifier OP1. The first resistor R1 is connected to the second input end of the first amplifier OP1. The fourth transistor Q2 has a fourth emitter thereof being connected to the first resister R1.

The first transistor M1, the second transistor M2, the third transistor Q1, the fourth transistor Q2, the first resistor R1 and the first amplifier OP1 form a self-bias circuit for generating a current as follows, $$I1 = I_{M1} = \frac{V_T \ln N}{R1} \tag{6}$$

since $V_T$ has a characteristic of positive temperature coefficient, I1 can be expressed as the function of the positive temperature coefficient.

The first current generator 31 further includes a fifth transistor M3 and a node located between the first resistor R1 and the emitter of the fourth transistor Q2 for outputting a node voltage. The node voltage has a characteristic of negative temperature coefficient. The fifth transistor M3 has a gate thereof being connected to both gates of the first and the second transistors M1, M2. The drain of the fifth transistor M3 outputs the first reference current I1.

Next, the second current generator 32 comprises a voltage-controlled current source and a current mirror. The voltage-controlled current source comprises a second amplifier OP2, a sixth transistor M4 and a second resistor R7. One input end (for example, a negative input end) of the second amplifier OP2 is connected to the emitter of the fourth transistor Q2 for accepting the node voltage, while another input end (positive input end) thereof is connected to the working voltage VSS through the second resistor R7. The output end of the second amplifier OP2 is connected to the gate of the sixth transistor M4. Therefore, the current on the R7 is $V_{BE2}/R7$. The sixth and seventh transistors M4 and M5 establish a current mirror, and its Aspect Ratio can be 1 to 1. The seventh transistor M5 includes a seventh gate and a seventh drain. The seventh gate of the seventh transistor M5 is connected to the sixth gate of the sixth transistor M4. The seventh drain of the seventh transistor M5 outputs the second reference current. The current on the drain of the seventh transistor M5 is:

$$I2 = \frac{V_{BE2}}{R7} \tag{7}$$

since $V_{BE2}$ has a characteristic of negative temperature coefficient, I2 can be expressed as the function of the negative temperature coefficient.

Because the I1 and I2 are connected in parallel, the current on the output resistor R8 is I1+I2. Thereby the bandgap voltage Vbg is:

$$Vbg = R8(I1 + I2) = R8\left(\frac{V_T \ln N}{R1} + \frac{V_{BE2}}{R7}\right) \quad (8)$$

Of course, a starting circuit can be added to the bandgap voltage reference circuit of the present invention so as to increase the steadiness when starting. As shown in FIG. 3, the bandgap voltage reference circuit 30 further comprises an eighth transistor M0, an auxiliary transistor Mx (also referred as the ninth transistor) and a starting circuit 33. The starting circuit 33 is used to check the current Ix on the eighth transistor M0 to control the auxiliary transistor Mx. If the current Ix on the eighth transistor M0 is 0 (zero), the auxiliary transistor Mx will be turned on, and if the current Ix is not zero, the auxiliary transistor Mx will be turned off. Since the starting circuit 33 controls the auxiliary transistor Mx only depending on the fact that if the current Ix is equal to 0, the circuit is really easy to design and implement.

Figure 4:
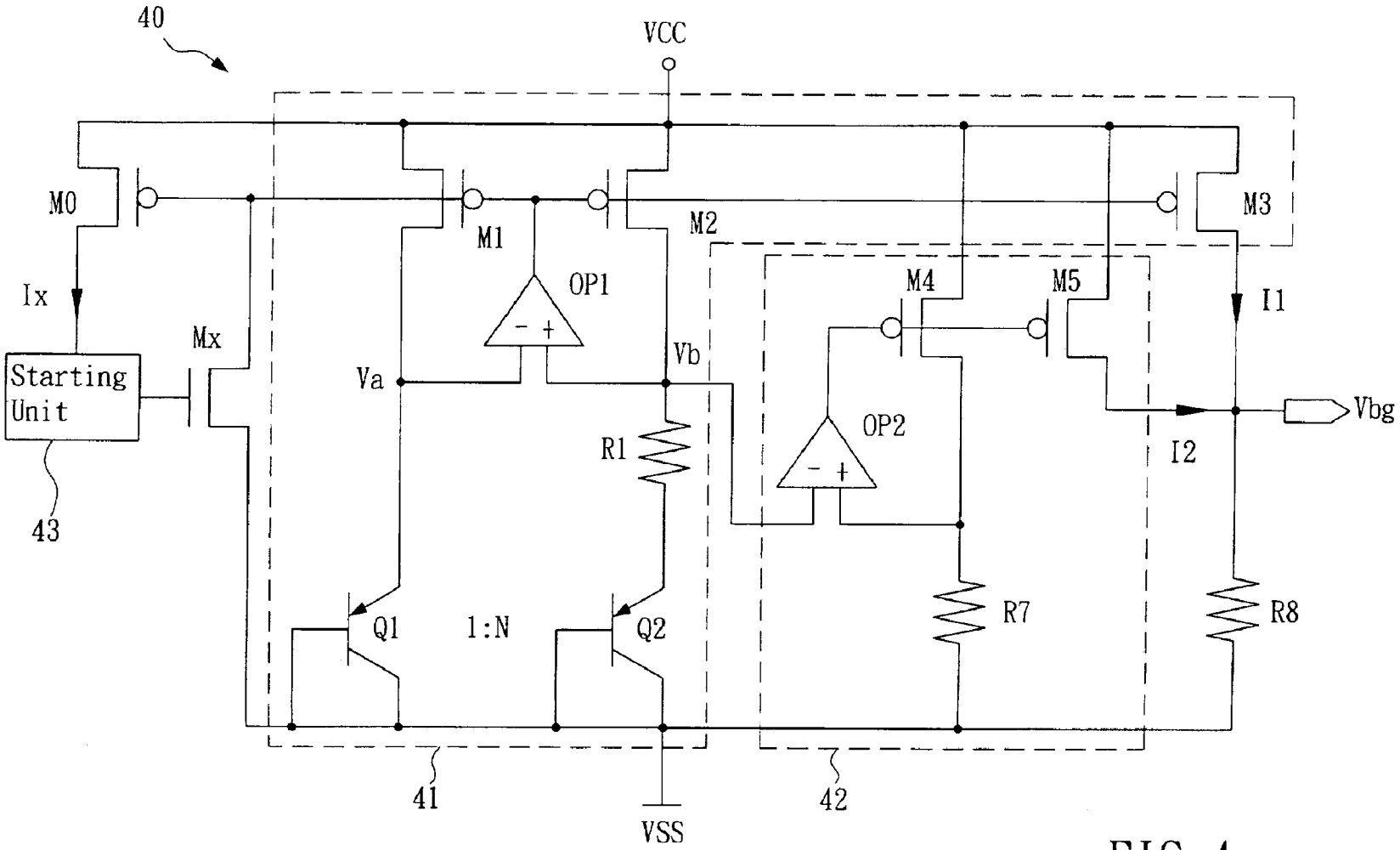
FIG. 4 shows the diagram of another embodiment of the fast start-up low-voltage bandgap voltage reference circuit in accordance with the present invention.

FIG. 4 is showing the diagram of another embodiment of the present invention. Basically, the circuit shown in FIG. 4 is similar to the circuit shown in FIG. 3, which also comprises the first current generator 41 and the second current generator 42. The only difference is that, in the embodiment shown in FIG. 4, the negative input end of the second amplifier OP2 is connected to the positive input end of the first amplifier OP1 for accepting the node voltage. That means, the node voltage is the voltage Vb of the first current generator 41. Therefore, the current on the seventh transistor M5 is:

$$I2 = \frac{V_{BE1}}{R7} \quad (9)$$

since $V_{BE1}$ has a characteristic of negative temperature coefficient, I2 can be expressed as the function of the negative temperature coefficient.

Because the I1 and I2 are connected in parallel, the current on the output resistor R8 is I1+I2. Thereby the bandgap voltage Vbg is:

$$Vbg = R8(I1 + I2) = R8\left(\frac{V_T \ln N}{R1} + \frac{V_{BE1}}{R7}\right) \quad (10)$$

Since the bandgap voltage Vbg of the bandgap voltage reference circuit of the present invention is generated by using the output resistor to transform the current obtained from adding the first reference current which has a positive temperature coefficient and the second reference current which has a negative temperature coefficient, therefore the bandgap voltage reference circuit of the present invention will work normally when the working voltage VCC is lower than 1.2 V.

The voltage difference between the two input ends of the first amplifier OP1 is $V_a - V_b = V_T \ln N - I_{R1}R1$. When the circuit is starting and the $I_{R1}$ is not big enough, the voltage difference $V_a - V_b$ will be lager than 0 (zero), and will consequently cause the output of the first amplifier OP1 to go down. Therefore, the current on the transistors M1 and M2 will increase so as to cause the voltage difference $V_a - V_b$ to keep going down till the self-bias circuit becomes steady. Since the transistors Q1 and Q2 are not connected parallel with the resistor, a bigger voltage difference $V_a - V_b$ will be obtained when starting, which will cause the transistors M1 and M2 to become steady rapidly. As a result, the bandgap voltage reference circuit of the present invention will not need an external reset signal for prompt start up.

Of course, a starting circuit can be added to the bandgap voltage reference circuit of the present invention so as to increase the steadiness when starting. As shown in FIG. 4, the bandgap voltage reference circuit 40 further comprises an eighth transistor M0, an auxiliary transistor Mx (also referred as the ninth transistor) and a starting circuit 43. The starting circuit 43 is used to check the current Ix on the eighth transistor M0 to control the auxiliary transistor Mx. If the current Ix on the eighth transistor M0 is 0 (zero), the auxiliary transistor Mx will be turned on, and if the current Ix is not zero, the auxiliary transistor Mx will be turned off. Since the starting circuit 43 controls the auxiliary transistor Mx only depending on the fact that if the current Ix is equal to 0, the circuit is really easy to design and implement.

While the present invention has been shown and described with reference to a preferred embodiment thereof, and in terms of the illustrative drawings, it should be not considered as limited thereby. Various possible modification, omission, and alterations could be conceived of by one skilled in the art to the form and the content of any particular embodiment, without departing from the scope and the sprit of the present invention.

What is claimed is:

1. A bandgap voltage reference circuit, said circuit comprising:

a first current generator for generating a first reference current with positive temperature coefficient, said first current generator having a self-bias circuit, and a node which outputs a node voltage with negative temperature coefficient;

a second current generator having a voltage-controlled current source receiving said node voltage for generating a second reference current with negative temperature coefficient according to the node voltage; and an output resistor accepting both the first reference current and the second reference current for outputting a bandgap voltage according to the first reference current and the second reference current;

wherein the self-bias circuit further comprises:

a first transistor having a first gate and a first drain;

a second transistor having a second drain and a second gate, the second gate being coupled to the first gate;

a first amplifier having a first input end, a second input end and an output end, said output end being coupled to both gates of the first and the second transistors, the first input end and the second input end being coupled to the drains of the first and the second transistors respectively;

a third transistor having a third emitter thereof coupled to the first input end of the first amplifier;

a first resistor coupled to the second input end of the first amplifier; and a fourth transistor having a fourth emitter thereof coupled to the first resistor, wherein the node is coupled to the fourth emitter of the fourth transistor.

2. The bandgap voltage reference circuit of claim 1, wherein the first current generator comprises a first current mirror which includes a fifth transistor, said fifth transistor having a fifth drain a fifth gate, said fifth gate being connected to both gates of the first and the second transistors, said fifth drain outputting the first reference current.

3. The bandgap voltage reference circuit of claim 1, wherein the voltage-controlled current source comprises:

a second resistor;

a second amplifier having an output end, a first input end and a second input end, said first input end being connected to the node, the second input end being connected the second resistor; and a sixth transistor having a sixth gate and a sixth drain, said sixth gate being connected to the output end of the second amplifier, the sixth drain being connected to the second input end of the second amplifier.

4. The bandgap voltage reference circuit of claim 3, wherein the second current generator comprises a second current mirror which comprises a seventh transistor, said seventh transistor having a seventh gate connected to the sixth gate of the sixth transistor and a seventh drain for outputting the second reference current.

5. The bandgap voltage reference circuit of claim 1, further comprising:

an eighth transistor having an eighth gate thereof connected to both the gates of the first and second transistors;

a ninth transistor having an ninth drain thereof connected to the eighth gate of the eighth transistor; and a starting circuit connected to the eighth and the ninth transistors for controlling the ninth transistor according to a current received from the eighth transistor.

6. A circuit for generating a bandgap voltage, said circuit comprising:

a bandgap reference circuit for generating a first reference current with positive temperature coefficient, wherein the bandgap reference circuit includes a node for outputting a node voltage with negative temperature coefficient;

a voltage-controlled current source coupled to the node for producing a second reference current with negative temperature coefficient according the node voltage;

a current mirror coupled to the voltage-controlled current source for outputting the second reference current;

an output resistor, said output resistor accepting both the first reference current and the second reference current for outputting the bandgap voltage according to the first and second reference currents;

a first transistor having a first gate thereof coupled to the band gap reference circuit;

a second transistor having a second drain thereof coupled to the first gate of the first transistor; and a starting circuit coupled to the first and the second transistors for controlling the second transistor according to a current received from the first transistor.

7. The circuit of claim 6, wherein the bandgap reference circuit further comprises:

a third transistor having a third gate and a third drain;

a fourth transistor having a fourth drain and a fourth gate, the fourth gate being connected to the third gate;

a first amplifier having a first input end, a second input end an output end, said output end being connected to both said gates of the third and the fourth transistors, the first input end and the second input end being connected to the drains of the third and the fourth transistors respectively;

a fifth transistor having a fifth emitter thereof connected to the first input end of the first amplifier;

a first resistor connected to the second input end of the first amplifier;

a sixth transistor having a sixth emitter thereof connected to the first resistor; and a seventh transistor having a seventh drain and a seventh gate, said seventh gate being connected to both gates of the third and the fourth transistors, said seventh drain outputting the first reference current.

8. The circuit of claim 7, wherein the node is connected to the sixth emitter of the fourth transistor.

9. The circuit of claim 7, wherein the node is connected to the second input end of the first amplifier.

10. The circuit of claim 7, wherein the voltage-controlled current source comprises:

a second resistor;

a second amplifier having an output end, a first input end and a second input end, said first input end being connected to the node, the second input end being connected the second resistor; and an eighth transistor having an eighth gate and an eighth drain, said eighth gate being connected to the output end of the second amplifier, the sixth drain being connected to the second input end of the second amplifier.

11. The circuit of claim 10, wherein the current mirror comprises a ninth transistor, said ninth transistor having a ninth gate connected to the eighth gate of the eighth transistor and a ninth drain for outputting the second reference current.

12. The circuit of claim 6, wherein the starting unit comprises a power-on reset circuit.

13. A circuit for generating a bandgap voltage, said circuit comprising:

a first current generator for generating a first reference current with positive temperature coefficient, wherein the first current generator includes a node for outputting a node voltage with negative temperature coefficient;

a voltage-controlled current source coupled to the node for producing a second reference current with negative temperature coefficient according the node voltage;

an output resistor, said output resistor accepting both the first reference current and the second reference current for outputting the bandgap voltage according to the first and second reference currents;

a first transistor having a first gate thereof coupled to the first current generator;

a second transistor having a second drain thereof coupled to the first gate of the first transistor; and a starting circuit coupled to the first and the second transistors for controlling the second transistor according to a current received from the first transistor.

14. The circuit of claim 13, wherein the first current generator is a bandgap reference circuit.

* * * * *